US005564954A

United States Patent [19]

Wurster

[11] Patent Number: 5,564,954

[45] Date of Patent: Oct. 15, 1996

[54] CONTACT WITH COMPLIANT SECTION

[76] Inventor: Woody Wurster, 502 W. Robinson, Carson City, Nev. 89703

[21] Appl. No.: 370,513

[22] Filed: Jan. 9, 1995

[51] Int. Cl.[6] ..... H01R 13/41

[52] U.S. Cl. ..... 439/751; 439/82

[58] Field of Search ..... 439/751, 82, 84, 439/873

[56] References Cited

U.S. PATENT DOCUMENTS

| | | | |
|---|---|---|---|
| 4,363,529 | 12/1982 | Loose . | |
| 4,655,537 | 4/1987 | Andrews . | |
| 4,701,140 | 10/1987 | Orbanic | 439/751 |
| 4,857,018 | 8/1989 | Pickles | 439/751 |

*Primary Examiner*—Gary F. Paumen

*Attorney, Agent, or Firm*—Freilich Hornbaker Rosen

[57] ABSTRACT

An electrical contact is provided for press-fit insertion into a circuit board, which provides a large retention force (resistance to pullout) even for very small circuit board holes. A compliant section (14, FIG. 1) of the contact, which lies in the hole, is of the eye-of-the-needle type which includes a pair of largely parallel beams (24, 26) with opposite ends that merge and with middle portions (30, 32) that are laterally spaced. Additional holding power is achieved by providing a protuberance (40, 42) on a middle portion of each beam, which projects towards the other beam. When the contact is press-fit in a circuit board hole, at least the tips of the protuberances are crushed, or plastically deformed. The protuberances preferably have sides that are tapered, and the average axial length (H, FIG. 4) of each protuberance is preferably between onethird and three times its thickness (T).

9 Claims, 4 Drawing Sheets

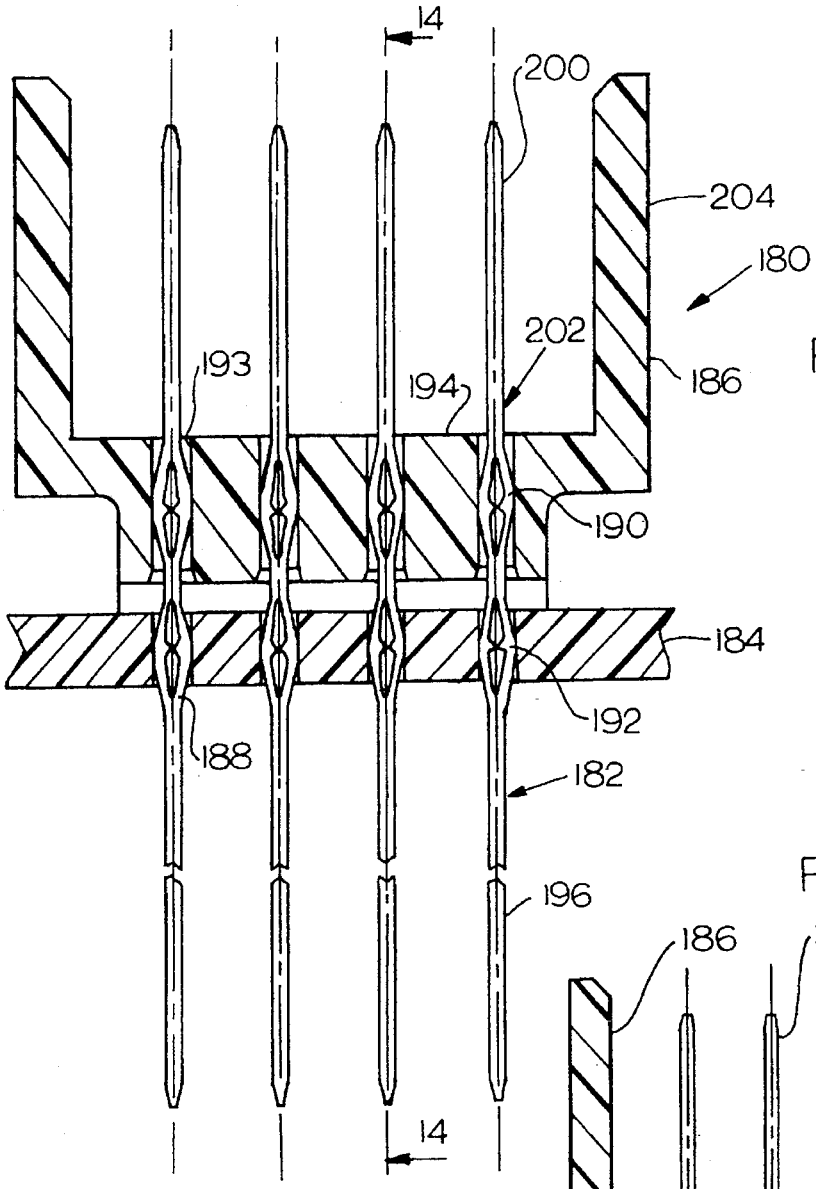
FIG. 13
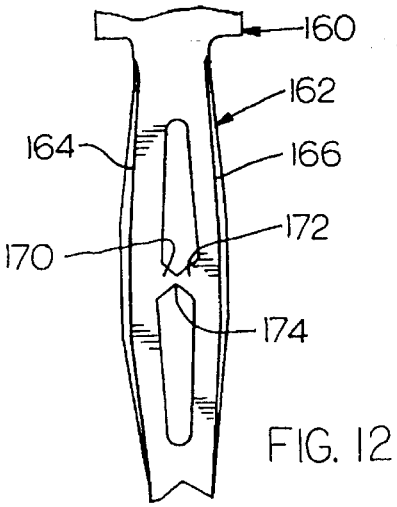
FIG. 12
FIG. 14
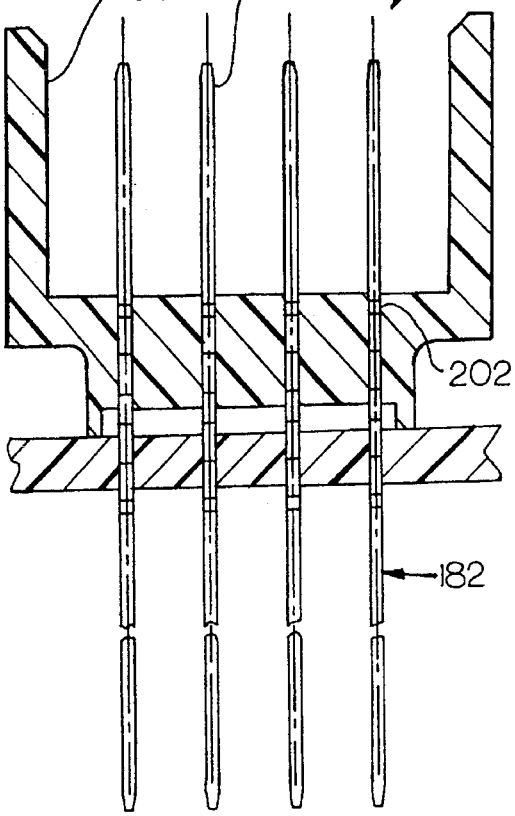

CONTACT WITH COMPLIANT SECTION

BACKGROUND OF THE INVENTION

Electrical contacts such as those projecting from a connector housing and those that are free standing, are commonly provided with compliant sections that can be press fit into plated circuit board holes and which resist pullout from the holes. One type of compliant section is the eye-of-the-needle type that has an elongated slot that divides the contact section into a pair of largely parallel spaced beams. The middles of the beams are deflected closer together when press fit into the circuit board hole.

For circuit board holes of at least twenty-five thousandths inch (with a typical allowable range of 25 to 31 thousandth inch), the simple eye-of-the-needle construction provides a holding or retention force (resistance to pull-out) of at least about 4.5 pounds, which is a minimum specified in many applications. However, for much smaller hole sizes such as twenty-two thousandths inch (a range such as 22 to 27 thousandths inch) or less, applicant finds that the simple eye-of-the-needle construction provides a holding force that is no more than about 1.5 pounds, which is considerably less than the minimum designated force of about 3.3 pounds (for a 22 thousandths inch minimum). The lower retention force is largely due to the fact that thinner sheet metal must be used. The need for a considerable retention force for small contacts that fit in very small holes, has been increasing as contacts have become smaller to accommodate the need for higher densities of contacts.

SUMMARY OF THE INVENTION

In accordance with one embodiment of the present invention, an electrical contact is provided, whose compliant section provides an increased retention force. The compliant section has a slot that divides it into two laterally-spaced largely parallel beams. The middle portion of at least one of the beams has a protuberance which projects laterally towards the other beam. As the beams are pressed together during press fitting into a circuit board hole, the free end of the protuberance is crushed, or plastically deformed. The resistance of the protuberance to further deflection of the beams towards each other, causes the beams to press more forcefully against the hole walls, which provides an enhanced retention force. The fact that the protuberance can be crushed to decrease its lateral length, avoids excessive damage to the walls of the hole and to the circuit board, when: the hole is of small diameter (but within tolerance limits).

The compliant section can be constructed largely symmetrically, so there is a protuberance projecting from each beam. Each protuberance is preferably tapered so its free end is of smallest axial length, with each side of the protuberance extending by an angle of about 45° from the lateral direction. The average axial length of each protuberance is of the same order of magnitude as the average thickness of each protuberance, to facilitate protuberance crushing when installed in a small diameter hole.

The novel features of the invention are set forth with particularity in the appended claims. The invention will be best understood from the following description when read in conjunction with the accompanying drawings.

BRIEF DESCRIPTION OF THE DRAWINGS

FIG. 12 is a front elevation view of the compliant section of a contact constructed in accordance with another embodiment of the invention.

FIG. 13 is a sectional view of a group of header electrical contacts which hold a connector housing to a circuit board and which serve as connector contacts.

FIG. 14. is a view taken on line 14—14 of FIG. 13.

DESCRIPTION OF THE PREFERRED EMBODIMENTS

Figure 1:
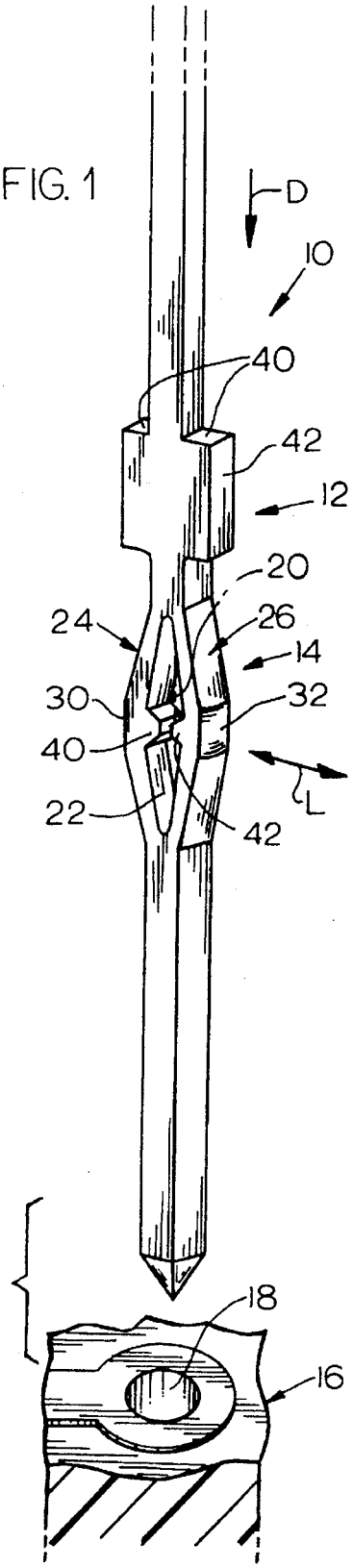
FIG. 1 is an exploded partial isometric view of an electrical contact and a circuit board constructed in accordance with one embodiment of the present invention.

FIG. 1 illustrates a combination 10 of an electrical contact 12 having a compliant section 14 for press fit insertion into a circuit board hole, and a circuit board 16 with a metal plated hole 18. The compliant section 14 has an axis 20 and has a slot 22 extending along the axis and dividing the compliant section into laterally spaced (along lateral direction L) first and second beams 24, 26. Each beam has a middle portion 30, 32 that is designed to engage the walls of the hole, and although the hole walls are somewhat plastically deformed, they still resiliently press the middle portions closer together. The middle portions of the beams press outwardly against the hole walls, to provide a retention force whereby they resist pullout of the contact from the circuit board hole.

Figure 2:
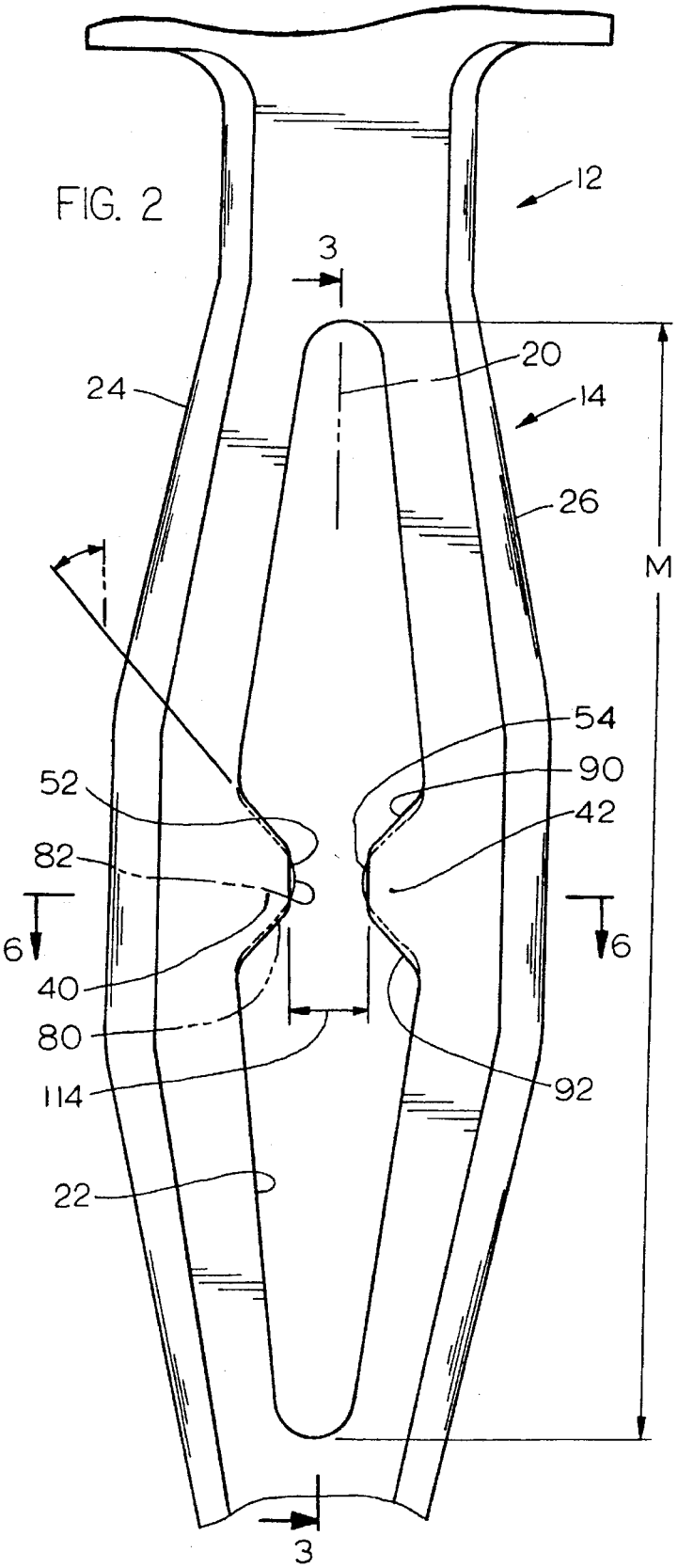
FIG. 2 is a front elevation view of a portion of the contact of FIG. 1.

In accordance with the present invention, applicant provides a pair of protuberances 40, 42 at the middle portions 30, 32 of the beams, with each protuberance extending towards the other beam. The contact is designed to be installed in the hole by downward force applied in the direction D against ledges 40 on a contact portion 42. As the compliant section enters the circuit board hole 18, the walls of the hole preferably press the middle portions of the beams close enough together that the projections 34, 36 abut and deform against each other. As shown in FIG. 2, each protuberance has a far end 52, 54 (the end farthest from the corresponding beam), with the far ends being free and spaced apart.

Figure 8:
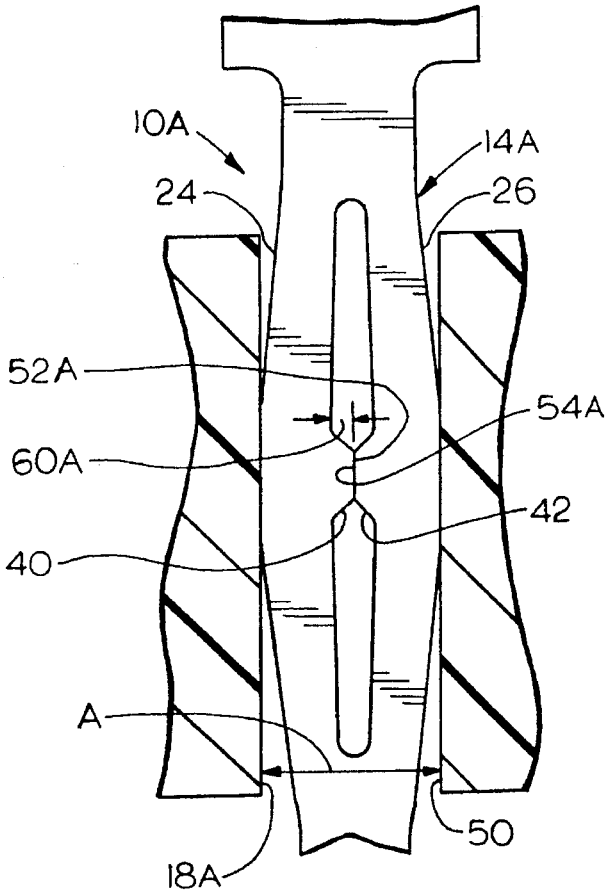
FIG. 8 is a front elevation view of a portion of the contact of FIG. 2, shown installed in a circuit board hole whose diameter is near the maximum of the range designated for use with that contact.

FIG. 8 shows a combination 10A wherein the compliant section at 14A is installed in a metal plated hole 18A whose diameter A is near the upper limit of the acceptable range of hole diameters. Nevertheless, the walls 50 of the hole have pressed the beams 24, 26 close enough together that it has caused the free ends 52A, 54A of the protuberances 40, 42 to be plastically deformed, so that the lateral length 60A of each protuberance has been reduced slightly. It would be sufficient for the free ends of the protuberances to merely touch and be only resiliently compressed, but this cannot be repeatedly achieved in practice.

Figure 9:
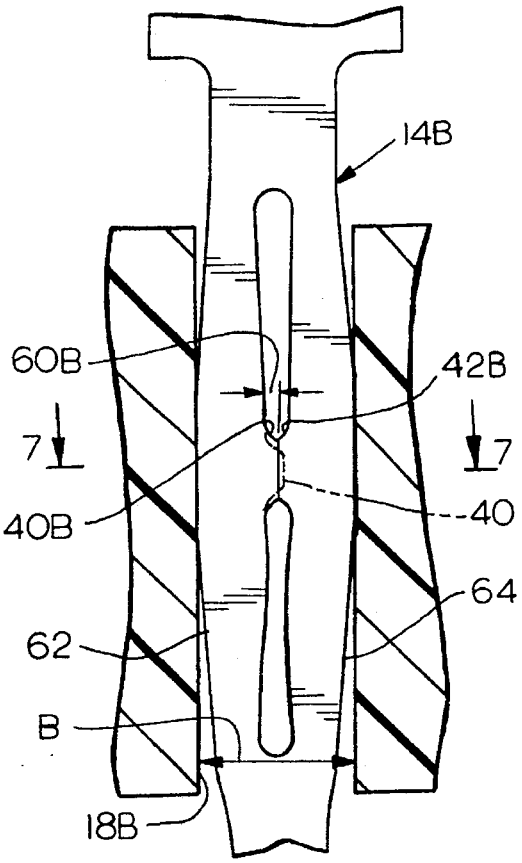
FIG. 9 is a view similar to that of FIG. 8, but showing the contact installed in a circuit board whose diameter is near the minimum of the range.
Figure 6:
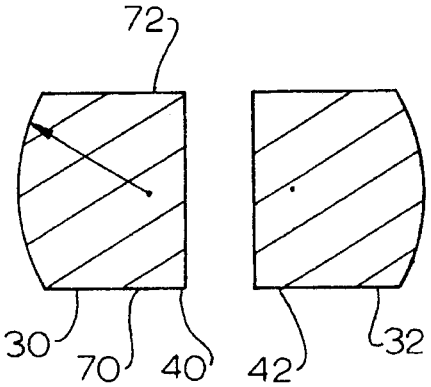
FIG. 6 is a view taken on line 6—6 of FIG. 2.
Figure 7:
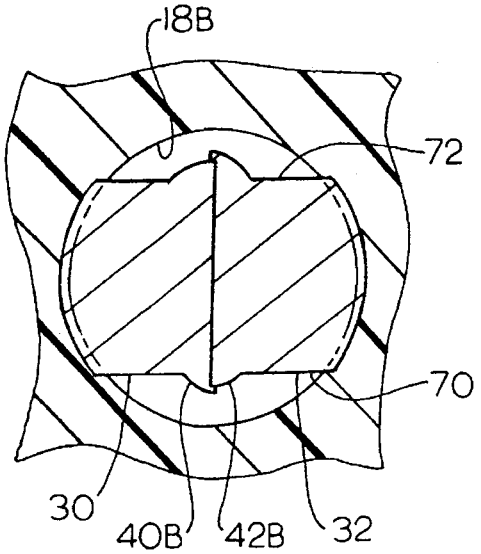
FIG. 7 is a view taken on line 7—7 of FIG. 9.

FIG. 9 shows the compliant section 14B after it has been installed in a hole 18B of a diameter B which is near the lower limit: of the acceptable range of diameters. It is noted that lower portions 62, 64 of the beams have been severely compressed as they initially entered the hole and expanded it. The protuberances at 40B, 42B have been severely deformed, and the height 60B of each has been considerably reduced. The amount of deformation can be appreciated by comparison to the initial shape and height ;of a protuberance, such as shown in phantom lines at 40, with the lateral length of the beam having been reduced by at least 5% and usually at least 10%. The protuberance is tapered in height, and the deformation tends to cause a slightly increased height of the protuberance. However, as shown in FIG. 7, the front and rear surfaces 70, 72 of the protuberance are largely parallel, and the deformation tends to cause a slightly increased thickness of the protuberances.

Figure 4:
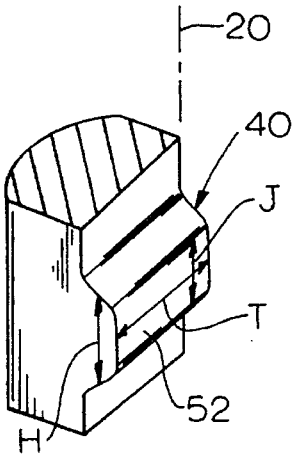
FIG. 4 is a partial isometric view of one of the beams of the contact of FIG. 2, showing details of the protuberance thereof.

Applicant prefers to construct each protuberance, such as 40 in FIG. 4, so its average height H, which is in an axial direction parallel to the axis 20, is of the same order of magnitude as its average thickness T, and with the average height H and the minimum height J which is at the free end of the tip, being relatively small. It would be possible to reduce the thickness T, but this would add to the cost of manufacture. Applicant prefers a small tip height J, so that a portion of the squeezing force applied by the hole walls, which is not resisted by bending of the beams, is concentrated in a relatively small area (J times T). Such relatively small area allows deformation of the projection with only minor expansion of the hole. A much greater expansion of the hole could cause undesirable damage to the circuit board.

Applicant initially provided protuberances as shown in phantom lines at 80 in FIG. 2 with rounded tips 82. The rounded tips 82 were effective in providing a high retention force. However, applicant found that care had to be exercised in installing the contact, or else one tip 82 could ride above the other tip, and cause skewing of the beams. To prevent such skewing, applicant modified the design so that the tips 52, 54 are substantially flat. The height J (FIG. 4) of the tips is made large enough only to prevent riding of the protuberances over each other.

The protuberances 40, 42 are each constructed with top and bottom walls, or sides 90, 92 which are each tapered at an angle C to the axis 20, which is preferably about 45°, that is, it is preferably between 30° and 60° . If the taper angle should vary, then the average (median) taper angle of the protuberance side is preferably between 30° and 60°. The angling of about 45° avoids upward or downward bending of the protuberances when they engage each other. Also, the tapering results in progressively increasing resistance to deformation of the protuberances as they are crushed.

As mentioned above, the thickness T (FIG. 4) of the protuberance could be reduced somewhat to provide a smaller cross section for the end of the protuberance, to result in less deformation of the hole. However, the average thickness T of the free end of the protuberance should be at least one-third and preferably at least one-half the maximum thickness of the beam middle portion. Each protuberance should be constructed so its average height H is no more than three times or less than one-third (and preferably no more than twice or less than one-half) of its average thickness T to provide a protuberance that is sturdy against being bent over, which has a relatively small cross sectional area so it can be plastically deformed without great damage to the circuit board hole and the circuit board, and so there is high assurance that the free ends of the protuberances will engage and plastically deform against each other instead of riding one over or beside the other.

Figure 3:
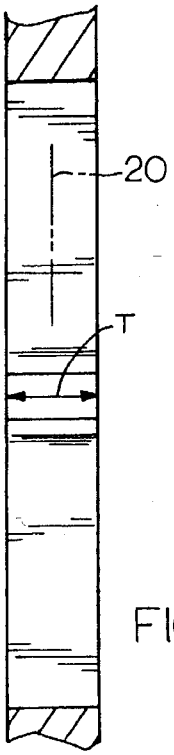
FIG. 3 is a view taken on line 3—3 of FIG. 2.

Applicant has designed contacts of the construction shown in FIGS. 1–8 for installation in holes having a nominal diameter of 0.63 millimeters, or 25 mils (1 mil equals one 1,000th inch), and with the tolerances allowing hole diameters ranging between 22 mils (0.56 mm) and 27 mils (0.69 mm). Each of the beams has a lateral width 100 (FIG. 5) of 14.6 mils (0.37 mm). Each protuberance has a tip height J (FIG. 5) of 6 mils (0.15 mm) (as measured between points that are first angled at 30° to the flat part of the tip). The tip has a flat part of a height Q of 2 mils (0.05 mm), with a radius of 3 mils (0.08 mm) at the upper and lower ends of the flat part. Each protuberance has a width K of 4 mils (0.10 mm), a maximum protuberance height P of 14 mils (0.36 mm), and an average protuberance height H of 10 mils (0.25 mm). The end of the protuberance opposite the free end or tip 52, is measured at the points 110, 112 where the angle D' with the axis is less than 30°, with locations beyond those points being part of the rest of the beams. As shown in FIG. 3, the thickness T at the middles of the beams is 15 mils (0.38 mm), and the entire contact is preferably of this thickness. The total height M (FIG. 2) of each beam is 85 mils (22mm), and the maximum height P (FIG. 5) of the protuberance (where its sides are first angled at 30° from the axis) is less than one-fourth the total beam height (i.e. height of slot 22 in FIG. 2). The contacts were constructed of phosphor bronze, and plated with nickel, with an overplating of tin. When installed in maximum diameter holes (0.69 mm) each of the protuberances had a reduction in lateral width of about 12%, and when installed in minimum diameter holes (0.56 mm) each of the protuberances had a reduction in lateral width of about 16%.

It is noted that in FIG. 2, the far or free ends 52, 54 of the protuberances are spaced apart by a distance 114 of 6 mils (0.15 mm). One reason for such spacing, is that the punch which punches out material to form the slot 22 requires a minimum lateral width at the protuberances, to prevent the punch from breaking. Also, a minimum gap is required for plating. Another reason is that the spacing of the far ends (preferably by at least one-half of the lateral length of each protuberance) assures considerable beam deflection before the far ends abut one another, so beam deflection adds substantially to the retention force.

Applicant has constructed and tested contacts of the construction illustrated in FIGS. 1–8 and described above, except that the tips of the protuberances were rounded (as at 82 in FIG. 2) with hole sizes ranging between 22 and 27 mils (0.56 and 0.69 mm). Applicant achieved a retention force of 4.5 pounds (which is greater than the specified minimum of 3.3 pounds), which is substantially greater than has been achieved heretofore with this general type of contact in such holes.

Figure 10:
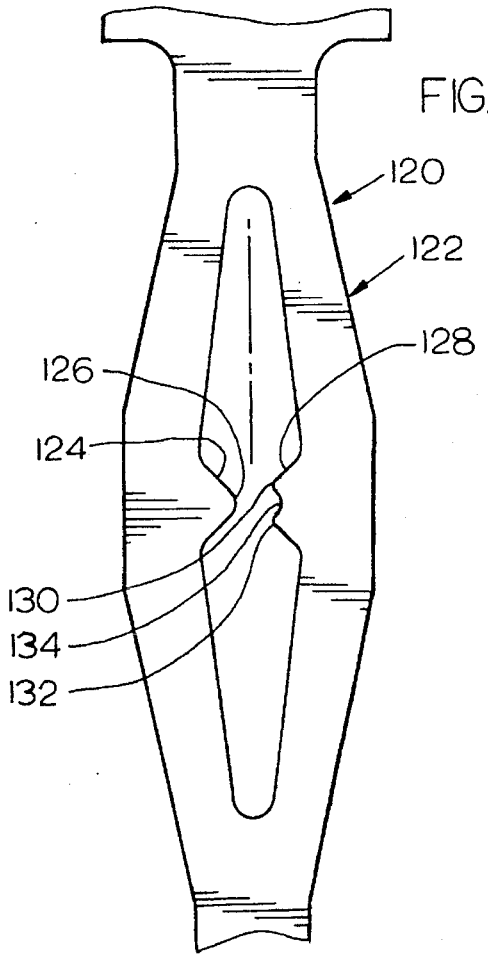
FIG. 10 is a front elevation view of the compliant section of a contact constructed in accordance with another embodiment of the invention.
Figure 5:
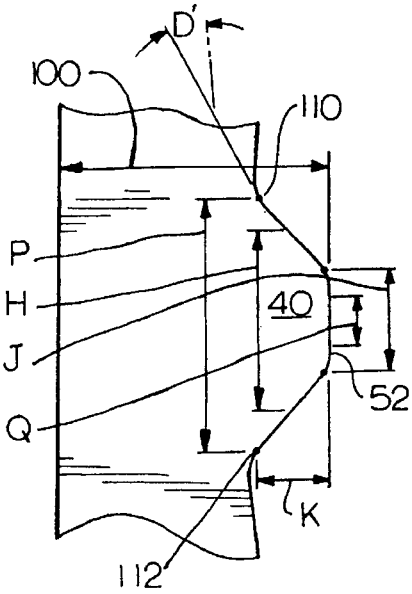
FIG. 5 is a side elevation view of the portion of the beam shown in FIG. 4.

FIG. 10 illustrates a contact 120 having a compliant section 122 wherein one protuberance 124 has a tip 126 which is rounded. The other protuberance 128 is formed with a pair of bumps 130, 132 to leave a recess 134 between them. This construction has the advantage that the recess 134 tends to guide the free end or tip 126 of the other protuberance into position so the protuberances firmly abut one another.

Figure 11:
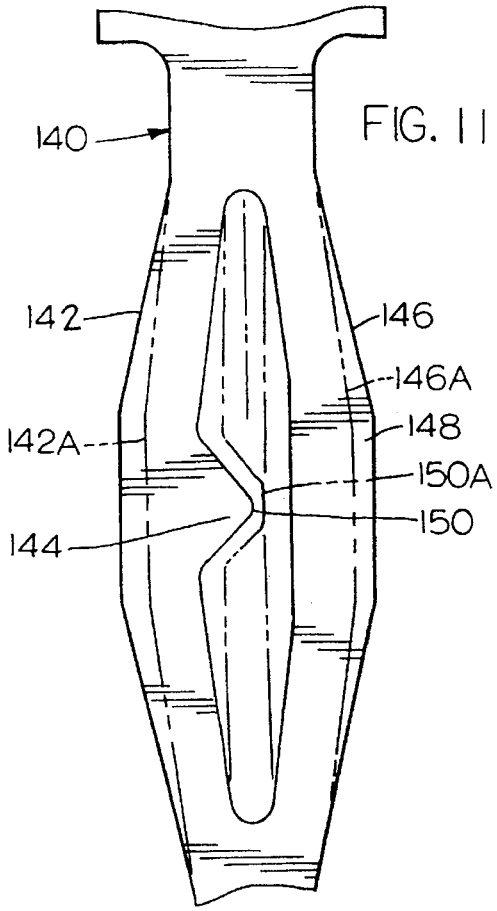
FIG. 11 is a front elevation view of the compliant section of a contact constructed in accordance with another embodiment of the invention.

FIG. 11 illustrates another contact 140 wherein one beam 142 is provided with a protuberance 144 while the other beam 146 has a middle portion 148 of slightly greater thickness (the two beams are equally resistant to bending), but without a protrusion thereon. When the contact is press fit into a hole, the tip 150 of the protuberance 144 is likely to flatten as indicated at 150A, against the other beam middle portion 148. Both beams might be expected to deflect to the positions 142A, 146A.

FIG. 12 illustrates a contact 160 having a compliant section 162 with two beams 164, 166 that each have a protuberance 170, 172 extending toward one another. However, the two protuberances have far ends, or tips that are not free, but which merge into one another. Where the protuberances are tapered in height, the far end of each protuberance is at 174 where the height (and/or thickness) is a minimum. If there is no tapering, the far end is half of the length of the two protuberances. This has the advantage that the protuberances are not likely to ride one over or beside each other. However, the beams are not deflected together by a considerable amount when they enter the hole, so beam deflections do not contribute as much to the retention force.

FIGS. 13 and 14 illustrates a combination 180 of header contacts 182, a circuit board 184, and a connector housing 186. Each contact 182 has compliant sections 190, 192 that are press fit respectively in a hole 188 in the circuit board 184 and in a hole 193 of a connector board part, or connector board, 194 of the housing. Each contact has a lower end 196 which is shown as a wire wrap terminal. Each contact has an upper end 200 which is part of the contact upper portion 202 that also includes the anchored compliant section 190. The upper end 200 forms a mating contact end which can slideably mate with a contact of opposite gender (a socket for the pin end 200) of another mating connector. A shroud 204 of the housing surrounds at least a portion of the mating contact end. The contact ends 196, 200 both have a maximum cross-section which is no greater than the diameters of the holes in the boards, which allows contact removal upward or downward.

While terms such as "vertical" or "down" have been used to aid in the description of the invention as illustrated, it should be understood that the parts can be used in any orientation with respect to Earth's gravity.

Thus, the invention provides an electrical contact with a compliant section of the eye-of-the-needle type (that is, with one or two elongated slot dividing it into two beams), which provides an enhanced retention force, especially for small diameter circuit board holes a minimum size of about 22 mils (0.56 mm) diameter (e.g. 22 to 27 mil) and less. At least one beam has a protuberance at the middle portion of the beam, with the protuberance projecting laterally towards the second beam, and preferably spaced from the second beam. Both beams can have protuberances, and it is even possible to provide a plurality of axially spaced protuberances on the middle portion of a beam. The protuberance is made long enough so that it will bottom on the other beam (as on a protuberance of the other beam) when the contact is installed in a circuit board hole that is close to a predetermined diameter, so the protuberance is at least slightly crushed for holes of less than maximum diameter. The average thickness T of the protuberance is preferably at least one-third but not more than three times the average height H of the protuberance. The average thickness and height of the protuberance is preferably no more than three times the maximum thickness or maximum lateral width of the beam. Each protuberance is preferably tapered in cross sectional area, so the cross sectional area progressively increases at locations progressively further from the far end of the protuberance, with each side of the protuberance preferably extending at an angle of between 30° and 60° from the axial direction. Where each beam has a protuberance, each protuberance can have a free end which is preferably substantially flat to prevent the protuberances from riding over or beside one another. In that case, the free ends of the protuberances are preferably spaced apart before insertion into the board hole. It is also possible to have the inner ends of the protuberances merge.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. An electrical contact for mounting in a circuit board hole, comprising:

a sheet of metal having a compliant section that has an elongated vertically-extending slot which forms a pair of beams lying on opposite sides of a vertical axis, with said beams having opposite ends that are joined to each other, with each beam having a middle beam portion, and with each beam having a protuberance at its middle beam portion which projects in a lateral direction towards the other protuberance, with each protuberance having converging opposite side portions that extend at an angle of at least 30° from said axis, and with said protuberances having free ends positioned to abut each other when said beams are pressed towards each other during insertion into said board hole to cause plastic deformation of said protuberances;

said protuberances each have an average height in an axial direction, and an average thickness in a thickness direction that is perpendicular to said axis and to said lateral direction, where said height is between one-third and three times said average thickness.

2. A combination of an electrical contact and a circuit board which has plated walls that form a hole with an axis, wherein said contact has a compliant section lying in said hole, characterized by:

said compliant section includes a slot forming first and second laterally-spaced beams having axially-spaced opposite ends that merge into each other and having beam middle portions that do not merge into each other, said beams each being pressed against a different side of said hole walls, with a first of said beam middle portions having a protuberance extending laterally towards said second beam, said protuberance not touching said second beam prior to insertion of said contact into said hole, with said protuberance having a far end that presses laterally against said second beam and that is compressed primarily laterally against the middle portion of said second beam, so the lateral length of said protuberance is reduced.

3. The combination described in claim 2 wherein:

the length of said protuberance in a direction parallel to said axis, is less than one fourth the length of said slot in a direction parallel to said axis.

4. A method for anchoring an electrical contact within a board hole, which includes forming a piece of sheet metal with an elongated compliant section having an elongated slot that leaves a pair of largely parallel laterally-spaced beams, and forcing said compliant section into said hole to cause walls of said hole to press said beams toward each other, characterized by:

said step of forming includes forming said elongated slot to leave a protuberance on at least a first of said beams that extends laterally toward the second of said beams and that has a free end closest to said second beam;

said step of forcing includes pressing said beams toward each other and plastically deforming said protuberance to reduce its lateral length.

5. The method described in claim 4 wherein:

said step of forcing includes reducing the lateral length of said protuberance by at least 10%.

6. An electrical contact which has a compliant section with an axis, for press fit into a hole of a board, wherein said compliant section is of the eye-of-the-needle type that includes first and second largely parallel beams with opposite ends that merge and with beam middle portions that are laterally spaced, and wherein said compliant section has an initial configuration prior to its insertion into the circuit board hole, characterized by:

in said initial configuration of said compliant section, said first beam has a protuberance on its middle portion, which projects laterally toward said second beam, and said protuberance has a far end opposite said first beam, with said protuberance far end having an average thickness in a thickness direction that is perpendicular to said lateral direction and to said axis, with said thickness being at least one-third the maximum thickness of said beam middle portion of said first beam and with said far end of said protuberance being positioned to be crushed against said second beam when said compliant section is forced into the board device hole;

said second beam and said protuberance far end are separated by a primarily vertical slot, and the total height of said protuberance is less than one-fourth the height of said slot.

7. The contact described in claim 6 wherein:

said first and second beams each have said protuberances at their beam middle portions, with the far ends of said protuberances being spaced and aligned to crush against one another when said compliant section is forced into said board hole.

8. The contact described in claim 6 wherein:

each of said protuberances has a substantially flat face, of an axial length that is at least one-third of said protuberance average thickness but not more than three times said protuberance average thickness.

9. A combination of a circuit board with a hole and an electrical contact which has a compliant section with an axis and which is press fit into said hole of a board, wherein said compliant section is of the eye-of-the-needle type that includes first and second largely parallel beams with opposite ends that merge and with beam middle portions that are initially laterally spaced, characterized by:

said first beam has a protuberance on its middle portion, which projects laterally toward said second beam, said protuberance not touching said second beam prior to insertion of said contact into said hole, and said protuberance has a far end opposite said first beam, with said protuberance having an average thickness in a thickness direction that is perpendicular to said lateral direction and to said axis, with said thickness being at least one-third the maximum thickness of said beam middle portion of said first beam and with said far end of said protuberance being laterally compressed against said second beam.

* * * * *